US010809045B1

(12) United States Patent
Teope et al.

(10) Patent No.: US 10,809,045 B1
(45) Date of Patent: Oct. 20, 2020

(54) FORWARD FIRING FRAGMENTATION (FFF) MUNITION INCLUDING FRAGMENTATION ADJUSTMENT SYSTEM AND ASSOCIATED METHODS

(71) Applicant: Government of the United States, as represented by the Secretary of the Air Force, Wright-Patterson AFB, OH (US)

(72) Inventors: Kaz I. Teope, USAF Academy, CO (US); Jacob B. Yarwood, USAF Academy, CO (US); Lucas A. Fumagalli, USAF Academy, CO (US); Kyle G. Senn, USAF Academy, CO (US); Philip T. Strunk, USAF Academy, CO (US); Michael L. Anderson, Colorado Springs, CO (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 16/259,130

(22) Filed: Jan. 28, 2019

Related U.S. Application Data

(60) Provisional application No. 62/669,654, filed on May 10, 2018.

(51) Int. Cl.
*F42B 12/22* (2006.01)
*F41G 7/20* (2006.01)

(52) U.S. Cl.
CPC ..... *F42B 12/22* (2013.01); *F41G 7/20* (2013.01)

(58) Field of Classification Search
CPC ..... F42B 12/22; F42B 12/24; F42B 12/26; F42B 12/28; F42B 12/30; F42B 12/32; F42B 15/01; F42B 15/04; F42B 99/00; F42B 15/38; F41G 7/20; F42C 13/00
USPC ..... 102/494, 493, 492, 491, 211, 389, 213, 102/293, 265
See application file for complete search history.

(56) References Cited

U.S. PATENT DOCUMENTS 2,308,672 A 1/1943 Brady, Jr.
2,782,716 A 2/1957 Johnston
4,519,315 A 5/1985 Arszman
(Continued)

OTHER PUBLICATIONS

Torrieri, Don J., "Statistical Theory of Passive Location Systems", U.S. Army Countermeasures/ Counter-Countermeasures Center, Apr. 1983 (48 Pages).

(Continued)

*Primary Examiner* — Jonathan C Weber
(74) *Attorney, Agent, or Firm* — AFMCLO/JAZ; Jeffrey R. Moore

(57) ABSTRACT

The forward firing fragmentation (FFF) munition includes a body, a flight system carried by the body and configured to maneuver the munition in flight, and a warhead carried by the body and including an explosive configured to detonate and expel fragments in a pattern. A near field barrier (near field barrier), such as the guidance system, is carried by the body in front of the warhead and communicatively coupled via a communication link to the flight system. A fragmentation adjustment system is configured to physically displace the near field barrier relative to the warhead while maintaining the communication link between the near field barrier and the flight system until detonation of the explosive.

16 Claims, 8 Drawing Sheets

(56) References Cited

U.S. PATENT DOCUMENTS

| | | | | |
|---|---|---|---|---|
| 4,533,094 | A | 8/1985 | Geis et al. | |
| 4,598,884 | A | 7/1986 | Speer | |
| 4,823,700 | A | 4/1989 | Alker et al. | |
| 4,867,357 | A * | 9/1989 | Inglis | F42B 15/36 244/121 |
| 5,159,151 | A * | 10/1992 | Dransfield | F42B 15/36 102/293 |
| 5,261,629 | A | 11/1993 | Becker et al. | |
| 5,287,810 | A | 2/1994 | Aumasson et al. | |
| 5,317,975 | A | 6/1994 | Sauvestre et al. | |
| 5,398,615 | A | 3/1995 | Johnsson et al. | |
| 5,544,589 | A | 8/1996 | Held | |
| 7,093,799 | B1 | 8/2006 | Dulat et al. | |
| 7,168,368 | B1 | 1/2007 | Warner et al. | |
| 7,930,978 | B1 | 4/2011 | Dupont et al. | |
| 8,413,585 | B2 | 4/2013 | Heitmann | |
| 9,273,943 | B1 * | 3/2016 | Poulsen | F42B 10/00 |
| 9,273,944 | B2 | 3/2016 | Collier | |
| 2011/0146523 | A1 * | 6/2011 | Kim | F42B 12/22 102/494 |
| 2013/0193264 | A1 | 8/2013 | Cohe et al. | |
| 2014/0145024 | A1 | 5/2014 | Cohe et al. | |

OTHER PUBLICATIONS

Salovaara et al., "Use of Future-Oriented Information in User-Centered Product Concept Ideation", Human-Computer Interaction—Interact, vol. 3585 2005 (pp. 727-740).

Gupta et al., "Effectiveness of Precision-Guided Munitions on Armour Systems", Defense Science Journal, vol. 57, No. 3, DESIDOC, May 2007 (pp. 281-287).

Mungan, "Internal Ballistics of a Pneumatic Potato Cannon", EP Journal of Physics, vol. 30, DOI: 10.1088/0143-0807/30/3/003, Mar. 2009 (pp. 453-457).

Budd, "Mind Maps as Classroom Exercises", Journal of Economic Education, vol. 35:1, Aug. 7, 2010 (pp. 35-46).

Shi et al., "Damage Radius Study of Gimbaled Forward-Firing Warhead to Tactical Ballistic Missile", Applied Mechanics and Materials, vol. 365-366, DOI: 10.4028/www.scientific.net/AMM.365-366.1312, 2013 (pp. 1312-1317).

* cited by examiner

FORWARD FIRING FRAGMENTATION (FFF) MUNITION INCLUDING FRAGMENTATION ADJUSTMENT SYSTEM AND ASSOCIATED METHODS

CROSS-REFERENCE TO RELATED APPLICATION(S)

This application claims the benefit of U.S. Provisional Patent Application No. 62/669,654 filed on May 10, 2018, which is incorporated herein by reference in its entirety.

GOVERNMENT INTEREST

The invention described herein may be manufactured and used by or for the Government of the United States for all governmental purposes without the payment of any royalty.

FIELD OF THE INVENTION

The present invention relates to the field of munitions, and more particularly, to forward firing fragmentation (FFF) munitions.

BACKGROUND OF THE INVENTION

Low collateral damage munitions (or "precision guided munitions" or "precision munitions") are pervasive in modern American warfare. In terms of mission effectiveness, these munitions "can encompass targets at the tactical, operational, and strategic levels of war and can be conducted by force elements fielded by armed services. Precision munitions may be dependent on a "seeker" for guidance and navigation for precision engagement. The seeker may include electro-optical, thermal, and/or infrared cameras, lenses, mirrors and other sensors along with gimbals and associated electronics. These seekers define a "Near Field Barrier" (NFB) which may be quite massive, e.g. as much as 30 lbs of guidance and/or detection electronics that often interferes with the desired munitions performance. The munition 10 configuration, depicted in FIG. 1, is for low collateral damage munitions and creates a fragmentation spread that is shown in the diagram of FIG. 2 because the near field barrier absorbs many of the warhead fragments at the center of the warhead.

FIG. 1 shows the relative location of the seeker (near field barrier) 12 in front of the warhead 14 carried by the munition body 13. Flight systems 16 may be at the rear of the munition 10. Forward firing fragmentation (FFF) weapons create a fragmentation spread seen in FIG. 2. This fragmentation spread lacks uniformity which is undesirable for a low collateral damage munition. The lack of uniformity is largely attributed to the placement of the seeker 12 at the forefront of the munition 10. This relative location of the seeker 12, or other near field barrier, creates an obstruction that results in the observed results seen in FIG. 2. It may be essential that the seeker 12 be located in front of the warhead 14 to ensure accurate guidance into the desired target.

Referring to FIG. 2, an observed fragmentation spread is shown for the low collateral damage munition 10 of FIG. 1. The small circles/dots 22 indicate fragment impact locations, which illustrate an uneven distribution of fragment impacts. Preferably, the inner circled region 20 would be completely filled with high-velocity impacts, which did not occur during this example munition test. The close proximity of the seeker 12 or near field barrier to the warhead 14 caused this incomplete fragmentation spread.

Some existing approaches teach the use of a cap, cone, and the like being jettisoned or ejected prior to impact or detonation of a warhead. For example, U.S. Pat. No. 5,261,629 to Becker et al. and titled "Fin Stabilized Projectile" teaches the use of a projectile tip with a sensor (e.g. seeker) that is ejected to expose a fragmentation plate prior to detonation of charge. Also, U.S. Pat. No. 4,823,700 to Alker et al. and titled "Missile with Remote-Controlled Warhead" discusses the use of a seeker head that is accelerated away from the warhead prior to hitting the target.

There may be a need for an approach to improve munition fragmentation by addressing the above described problem of poor fragmentation patterns of precision munitions, and including the near field barrier/seeker remaining in physical and/or electrical contact with the munition so that target location and/or guidance commands are continuously communicated to the munition guidance system.

This background information is provided to reveal information believed by the applicant to be of possible relevance to the present invention. No admission is necessarily intended, nor should be construed, that any of the preceding description constitutes prior art against the present invention.

BRIEF SUMMARY OF THE INVENTION

With the above in mind, embodiments of the present invention are related to an approach for refining munition fragmentation by improving the precision and lethality of small, precision munitions. In particular, the approach may allow the warhead fragments to project into a more concentrated area, thus placing more of the fragments on the desired target while avoiding unintended targets. For such precision munitions, it may be desirable for the fragmentation pattern to be focused on the desired target and evenly distributed throughout the target area. The approach may improve the fragmentation by physically displacing any near field barriers (near field barrier), such as the munition seeker (guidance system) away from the warhead prior to detonation.

Advantages may be provided by an embodiment that is directed to a forward firing fragmentation (FFF) munition including a body, a flight system carried by the body and configured to maneuver the munition in flight, and a warhead carried by the body and including an explosive configured to detonate and expel fragments in a pattern. A near field barrier (near field barrier), such as the guidance system, is carried by the body in front of the warhead and communicatively coupled via a communication link to the flight system. A fragmentation adjustment system is configured to physically displace the near field barrier relative to the warhead while maintaining the communication link between the near field barrier and the flight system until detonation of the explosive.

Additionally, or alternatively, an engine is carried by the body and configured to propel the forward firing fragmentation munition in flight.

Additionally, or alternatively, the fragmentation adjustment system may be an axial displacement system configured to axially displace the guidance system in a forward direction away from the warhead prior to detonation of the explosive while maintaining a physical coupling between the guidance system and the body and maintaining the communication link between the guidance system and the flight system until detonation of the explosive. The forward direction defined as an axial direction with the intended flight path of the forward firing fragmentation munition, generally from the flight system to the seeker/guidance system. As such, the axial displacement system may include at least one linear guide coupled between the body and the guidance system. The linear guide may be a plurality of extendable rods, or a sleeve, for example.

Additionally, or alternatively, the axial displacement system may include a plurality of communication tethers defining the communication link.

Additionally, or alternatively, the fragmentation adjustment system may be a pivotal displacement system configured to rotate the near field barrier in a direction away from the warhead prior to detonation of the explosive while maintaining a physical coupling between the near field barrier and the body and maintaining the communication link between the near field barrier and the flight system until detonation of the explosive. The rotation may be about the longitudinal axis or about the transverse axis, for example, and may include the use of a pivot mechanism or hinge mechanism.

Additionally, or alternatively, the fragmentation adjustment system may include a release mechanism configured to release the near field barrier for displacement away from the warhead prior to detonation of the explosive. The fragmentation adjustment system may further include a biasing mechanism configured to bias the near field barrier for displacement away from the warhead upon actuation of the release mechanism and prior to detonation of the explosive.

Embodiments of the present invention are also directed to a fragmentation adjustment system for a forward firing fragmentation (FFF) munition comprising a flight system to maneuver the munition in flight, a warhead including an explosive configured to detonate and expel fragments in a pattern, and a guidance system in front of the warhead and communicatively coupled to the flight system. The fragmentation adjustment system includes a displacement system configured to displace the guidance system in a direction away from the warhead prior to detonation of the explosive while maintaining a physical coupling between the guidance system and the body and maintaining a communication link between the guidance system and the flight system until detonation of the explosive, and at least one communication tether defining the communication link between the guidance system and the flight system.

Additionally, or alternatively, the displacement system comprises an axial displacement system configured to axially displace the guidance system in a forward direction away from the warhead prior to detonation of the explosive while maintaining the physical coupling between the guidance system and the body and maintaining the communication link between the guidance system and the flight system until detonation of the explosive.

Additionally, or alternatively, the displacement system comprises a pivotal displacement system configured to rotate the guidance system in a direction away from the warhead prior to detonation of the explosive while maintaining the physical coupling between the guidance system and the body and maintaining the communication link between the guidance system and the flight system until detonation of the explosive.

Additionally, or alternatively, the displacement system includes a release mechanism configured to release the guidance system for displacement away from the warhead prior to detonation of the explosive, and a biasing mechanism configured to bias the guidance system for displacement away from the warhead upon actuation of the release mechanism and prior to detonation of the explosive.

Embodiments of the present invention are also directed to a method of making a forward firing fragmentation (FFF) munition. The method includes: mounting a flight system to the body, the flight system configured to maneuver the munition in flight; mounting a warhead to the body, the warhead including an explosive configured to detonate and expel fragments in a pattern; mounting a near field barrier (near field barrier), such as a guidance system, to the body in front of the warhead and communicatively coupled via a communication link to the flight system; and providing a fragmentation adjustment system to physically displace the near field barrier relative to the warhead while maintaining the communication link between the guidance system and the flight system prior to detonation of the explosive.

Additionally, or alternatively, the fragmentation adjustment system comprises an axial displacement system configured to axially displace the guidance system in a forward direction away from the warhead prior to detonation of the explosive while maintaining a physical coupling between the guidance system and the body and maintaining the communication link between the guidance system and the flight system until detonation of the explosive.

Additionally, or alternatively, the fragmentation adjustment system comprises a pivotal displacement system configured to rotate the near field barrier in a direction away from the warhead prior to detonation of the explosive while maintaining a physical coupling between the near field barrier and the body and maintaining the communication link between the near field barrier and the flight system until detonation of the explosive.

Additionally, or alternatively, the fragmentation adjustment system includes a release mechanism configured to release the near field barrier for displacement away from the warhead prior to detonation of the explosive, and a biasing mechanism configured to bias the near field barrier for displacement away from the warhead upon actuation of the release mechanism and prior to detonation of the explosive.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 3:
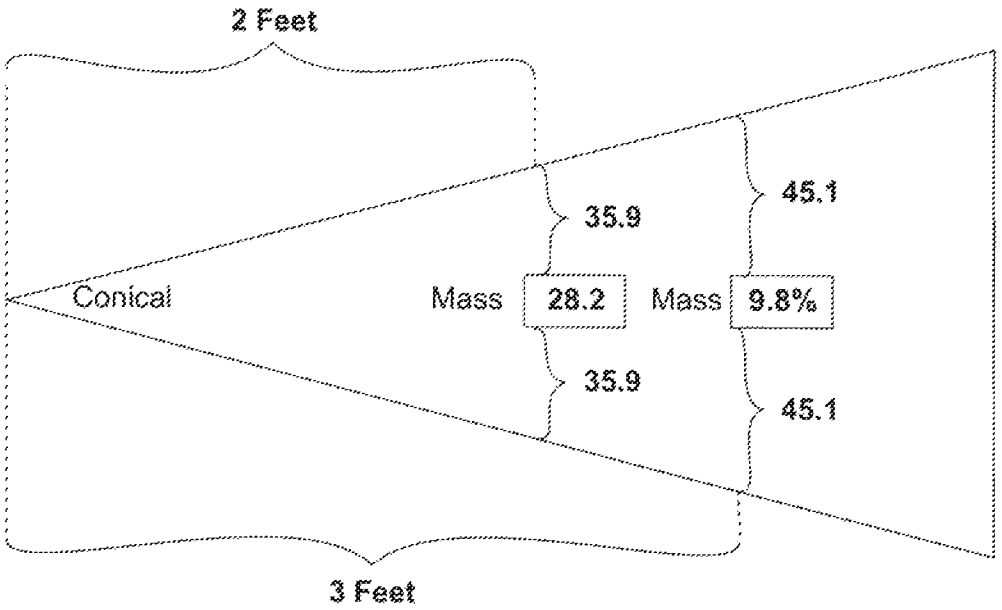
FIG. 3 is a diagram illustrating simulation data demonstrating the effectiveness of axially displacing a Near Field Barrier according to features of the present invention.

The present embodiments may provide reduced near field barrier (NFB) effects of the seeker and improve the fragmentation spread seen from forward firing fragmentation munitions. With reference to FIG. 3, simulation data is shown that demonstrates the effectiveness of axially displacing a near field barrier. The figure depicts a two-dimensional side view of the conical fragmentation pattern typical of a forward firing munition. The near field barrier obstructs a portion of the conical expansion of the fragments. Statistical results from simulations are shown reporting the predicted percentage of warhead fragments obstructed by the near field barrier when the near field barrier is axially displaced in front of the warhead by two feet and three feet, respectively. In this simulated scenario, if the near field barrier is left in place (no displacement), it absorbs over 90% of the fragments whereas displacing the near field barrier two feet from the front of the warhead, it blocks only 28.2% of the fragments allowing the remaining 71.8% to pass by. A three foot separation reduces the percentage of blocked fragments to only 9.8%. These simulations were verified with experimental test shots of a surrogate fragmentation propelling device.

This present approach incorporates a system which, in a controlled manner, displaces (e.g., axially) the near field barrier or seeker in front of the warhead, increasing the separation between the near field barrier and the warhead, thus reducing the effect of the near field barrier. The linear displacement reduces the shadow of the seeker relative to the outer diameter of the fragment pattern. The principal advantages may include: improving fragmentation pattern by focusing the fragments towards the center of the target area and creating a more even distribution of fragments; maintaining physical and electrical contact between the munition and the seeker throughout the detonation and without interfering with seeker operation which allows the seeker to operate through the entire engagement, and reliably guide the munition into the target, thus improving accuracy; maintaining physical contact between the munition and the seeker throughout the detonation which avoids potential legal restrictions applied to sub-munition warheads; ensuring displacement forces applied to the near field barrier and the munition are applied in a longitudinal direction so that the munition trajectory is not altered; the application to any forward firing fragmentation munition that suffers from near field barrier fragmentation shadow; no significant increase in cost or complexity of implementing precision munitions in combat; it is customizable to varying munition/near field barrier combinations and can be adjusted to provide adequate thrust for a given near field barrier mass/size/shape and/or to create the necessary separation and/or timing of near field barrier displacement and warhead detonation.

Figure 1:
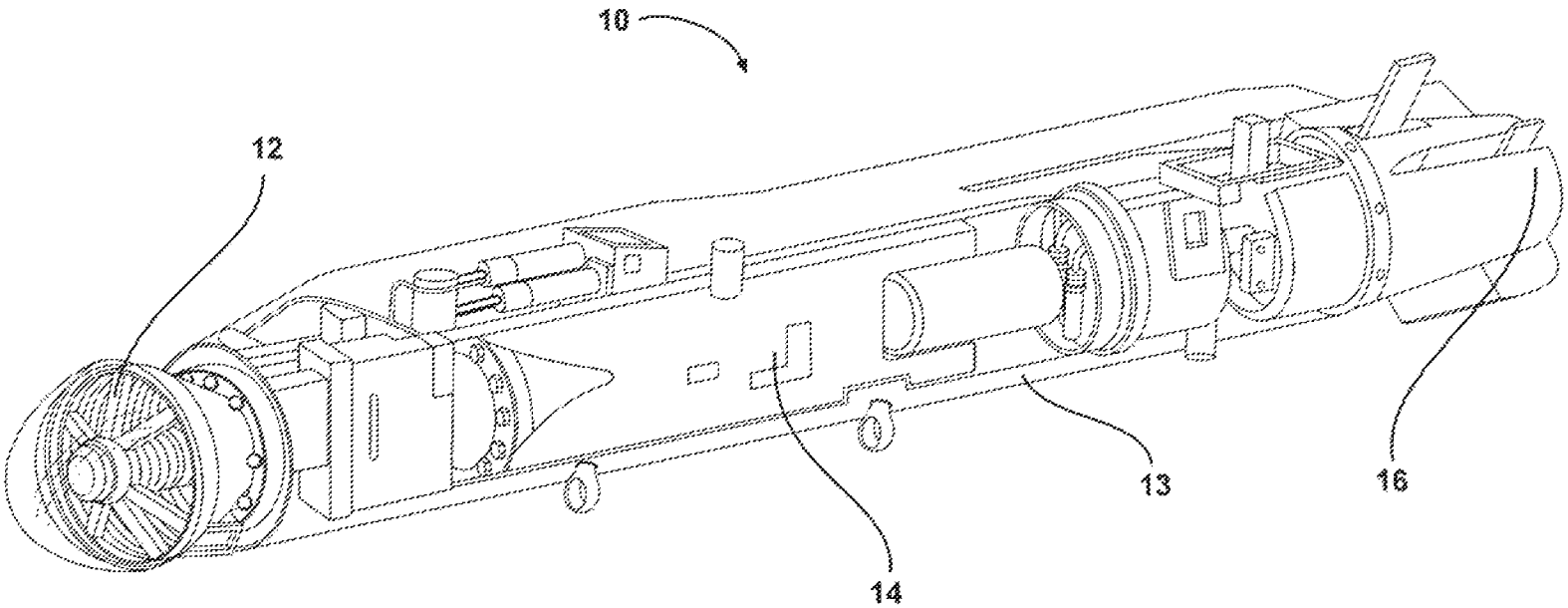
FIG. 1 is a perspective view of a typical low collateral munition according to the prior art.
Figure 2:
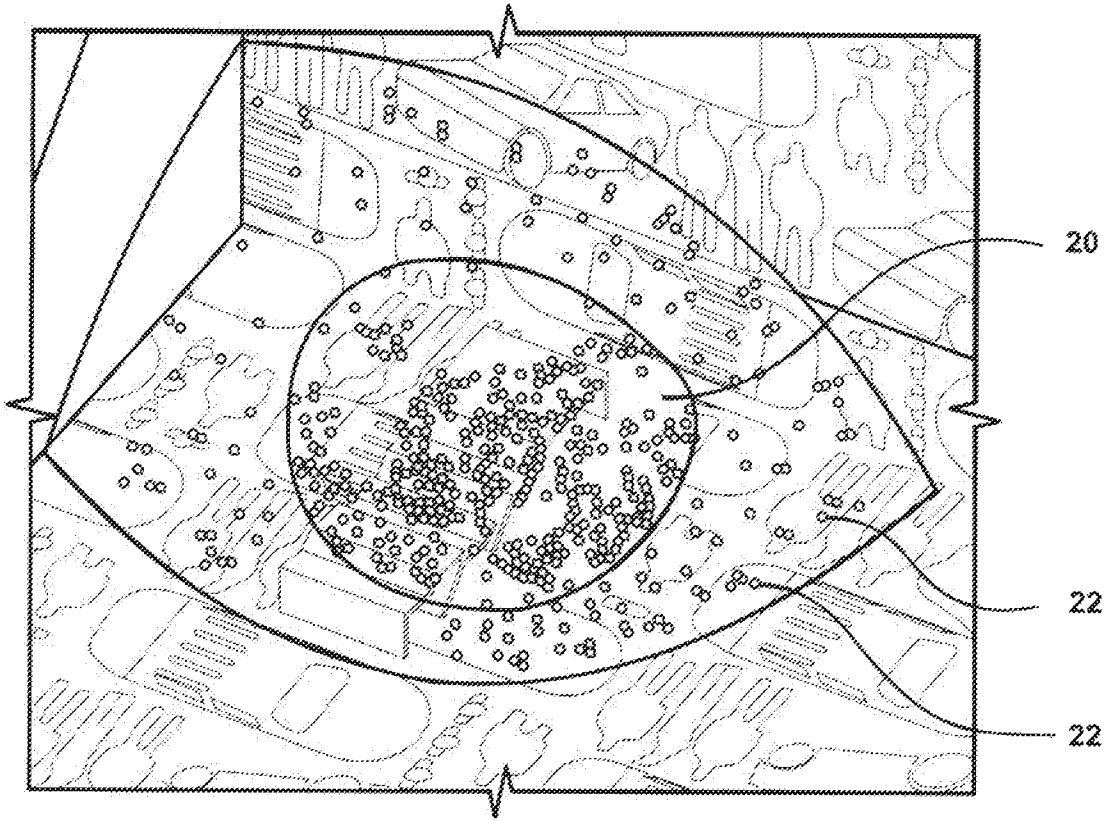
FIG. 2 is a diagram illustrating the fragmentation spread for the low collateral damage munition of FIG. 1.
Figure 4A:
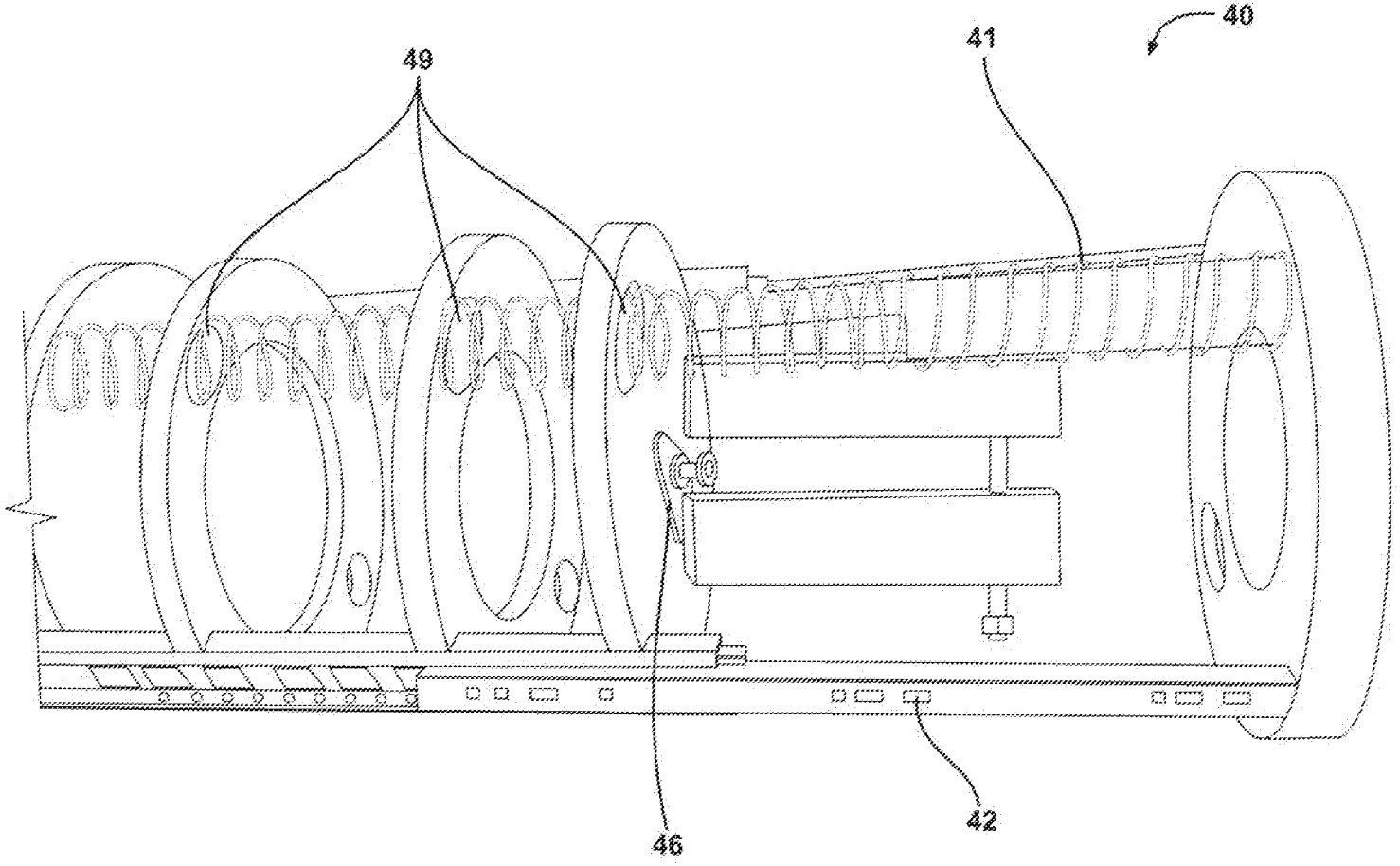
FIG. 4A is a schematic diagram illustrating an embodiment of a fragmentation adjustment system including a biasing mechanism according to features of the present invention.

FIG. 4A is a schematic diagram illustrating an embodiment of a fragmentation adjustment system 40 including a biasing mechanism such as a coil spring 41, according to features of the present invention. The fragmentation adjustment system 40 may be a part of an forward firing fragmentation munition 10 (as shown in FIG. 1) including a body 13, a flight system 16 carried by the body and configured to maneuver the munition in flight, and a warhead 14 carried by the body 13 and including an explosive configured to detonate and expel fragments in a pattern. A near field barrier 12, such as the guidance system, is carried by the body in front of the warhead 14 and communicatively coupled via a communication link (e.g., wired or wireless) to the flight system, as will be described in further detail below. As mentioned, precision munitions are dependent on a "seeker" for guidance and navigation for precision engagement. The seeker/near field barrier 12 (e.g. guidance system), may include electro-optical, thermal, and/or infrared cameras, lenses, mirrors and other sensors along with gimbals and associated electronics. The seeker and/or any other type of near field barrier may be quite massive, for example, as much as 30 lbs.

The fragmentation adjustment system 40 is configured to physically displace the near field barrier 12 relative to the warhead 14 while maintaining the communication link between the near field barrier 12 and the flight system 16 until detonation of the explosive. An engine may be carried by the body and configured to propel the forward firing fragmentation munition in flight.

The fragmentation adjustment system 40 may be an axial displacement system configured to axially displace the near field barrier 12 in a forward direction away from the warhead 14 prior to detonation of the explosive while maintaining a physical coupling between the near field barrier 12 and the body 13 and maintaining the communication link between the near field barrier 12 and the flight system 16 until detonation of the explosive. As such, the axial displacement system may include at least one linear guide 42 coupled between the body 13 and the near field barrier 12.

Figure 5:
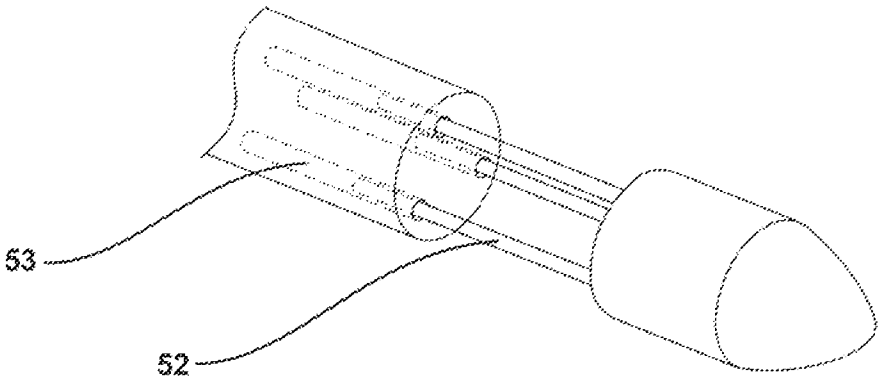
FIG. 5 is a schematic diagram illustrating another embodiment of a fragmentation adjustment system including axial displacement system according to features of the present invention.
Figure 6:
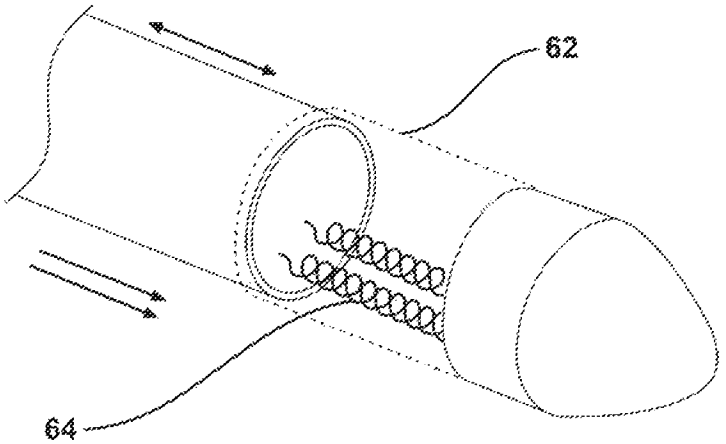
FIG. 6 is a schematic diagram illustrating another embodiment of a fragmentation adjustment system including axial displacement according to features of the present invention.

FIG. 4A shows the general concept of the axial displacement of the near field barrier 12 which is attached to one end of the linear guides 42 and is extended away from the munition body 13. The linear guide 42 can take any form that would allow the near field barrier 12 to be axially displaced in a forward direction away from the warhead 14. In FIG. 4A, the linear guide 42 is shown as interlocking rails that slide relative to each other (e.g. similar to a desk drawer rail). The linear guide may be a plurality of extendable rods 52 as illustrated in the embodiment of FIG. 5, for example. Such rods 52 may be driven mechanically, electrically or pneumatically, for example, and slide into tubes 53. The tubes 53 may be driven by air jets to fill the tubes 53 and extend the rods 52. Explosive bolts, linear actuators, ball screw actuators, electromagnets etc., are other examples of mechanisms for axial displacement. The mechanisms may use the munition's kinetic energy for operation. The linear guide may be a sleeve 62 as illustrated in FIG. 6, for example.

Previous approaches, such as cluster munitions, may eject the warhead (or multiple sub-munition warheads) radially out of the munition through a hatch. In contrast, in the present embodiment, during near field barrier displacement, the near field barrier/guidance system 12 remains in physical and electrical contact with the munition 10 so that target location and/or guidance commands are continuously communicated to the near field barrier/guidance system 12 for enhanced munition accuracy. The axial displacement approach ensures that the displacement forces applied to the near field barrier 12 and the corresponding reaction forces applied to the munition 10 are applied in a longitudinal direction so that the munition trajectory is not altered.

Figure 4B:
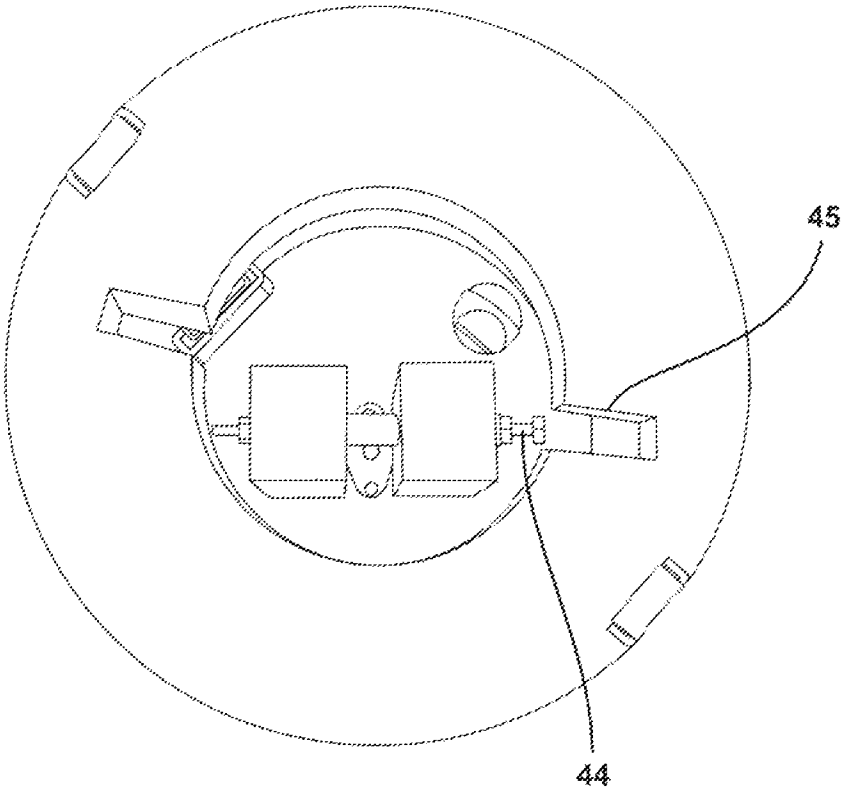
FIG. 4B is a schematic diagram illustrating an embodiment of a fragmentation adjustment system including a biasing mechanism according to features of the present invention.

Additional features may be needed to ensure proper operation such as a technique to energize the displacement, lock the near field barrier 12 in place during flight, and an actuator to displace the near field barrier 12. Examples of these features are shown in FIG. 4A and/or FIG. 4B. Coil or compression springs 41 are used to store the energy required to displace the near field barrier 12. A lock and key system is used to hold the near field barrier in place pre/post displacement, and it is designed so that it can provide the needed resistive force to the springs without requiring a high force to release it. This may be accomplished with a configuration that presents the spring compression forces in the munitions' longitudinal direction, while the "key" is unlocked by rotating it in the radial direction. The locking pawls 44 (FIG. 4B) may be ball bearings so that they may easily roll on the surface toward the keyway 45 without it being necessary to apply a high torque. Therefore, the un-locking actuator 46 (e.g. servo motor) is not required to overcome the spring force. A high torque servo motor may be used to turn the key in a radial direction until the pawls 44 align with the keyway 45. This opens the lock, allowing the springs to decompress and displace the near field barrier 12 away from the munition 10. Other types of biasing mechanisms and release mechanisms are also contemplated, as would be appreciated by those skilled in the art.

Referring again to FIG. 4A, the explosive material of the warhead 14 may be contained in the space within the lower portion of the fragmentation adjustment system 40. The middle may mount the actuator 46 or servo motor. The top section would be mounted to the base of the near field barrier 12, which, again, is preferably a guidance system or seeker. The top portion also has the release mechanism built into it as illustrated. All of these portions or sections may be held together by the linear guides 42 and may have collinear holes 49 to allow for the springs 41 to traverse the length of the system 40. The lower end is secured to the munition body 13 allowing the fragmentation adjustment system 40 to collapse upon itself when the springs 41 are compressed. The illustrated embodiment does create a near field barrier 12 in front of the explosive material; however, the near field barrier 12 is significantly easier to penetrate as it is preferably less than 1 lb of 3D printed plastic, for example, instead of the approximate 30 lbs of metal and glass characteristic of the guidance system.

As illustrated in the embodiment of FIG. 6, the guidance system electrical control and sensor data communication lines are shown as wired communication tethers 64 that are extensible to the length of the fragmentation adjustment system 40 so that two-way communication between the guidance system and the flight system 16 is maintained throughout the near field barrier displacement. Additionally, or alternatively, the axial displacement system may include a wireless communication interface (e.g., transmitter and receiver) to define the communication link.

Figure 8:
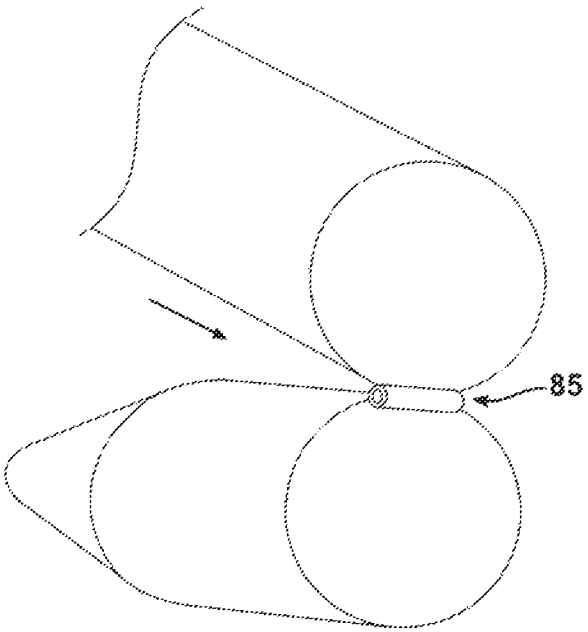
FIG. 8 is a schematic diagram illustrating another embodiment of a fragmentation adjustment system including rotational or hinged displacement according to features of the present invention.
Figure 7:
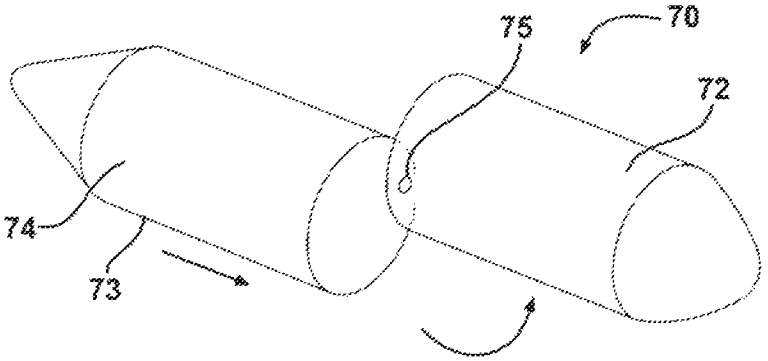
FIG. 7 is a schematic diagram illustrating another embodiment of a fragmentation adjustment system including rotational or pivotal displacement according to features of the present invention.

With additional reference to FIGS. 7 and 8, in other embodiments, the fragmentation adjustment system may be a pivotal displacement system 70 configured to rotate the near field barrier 72 in a direction away from the warhead 74 prior to detonation of the explosive while maintaining a physical coupling between the near field barrier 72 and the body 73 and maintaining the communication link between the near field barrier and the flight system 16 until detonation of the explosive. The rotation may be about the longitudinal axis or about the transverse axis, for example, and may include the use of a pivot mechanism 75 or hinge mechanism 85, as in FIG. 9.

With additional reference to FIGS. 9 and 10, example embodiments of a release mechanism will be described. The release mechanisms 90 and 100 in FIGS. 9 and 10 respectively, are configured to release the near field barrier 92/102 for displacement away from the warhead 94/104 prior to detonation of the explosive. As discussed above, the fragmentation adjustment system 40 may include a biasing mechanism 41 configured to bias the near field barrier for displacement away from the warhead upon actuation of the release mechanism 90/100 and prior to detonation of the explosive.

Figure 9:
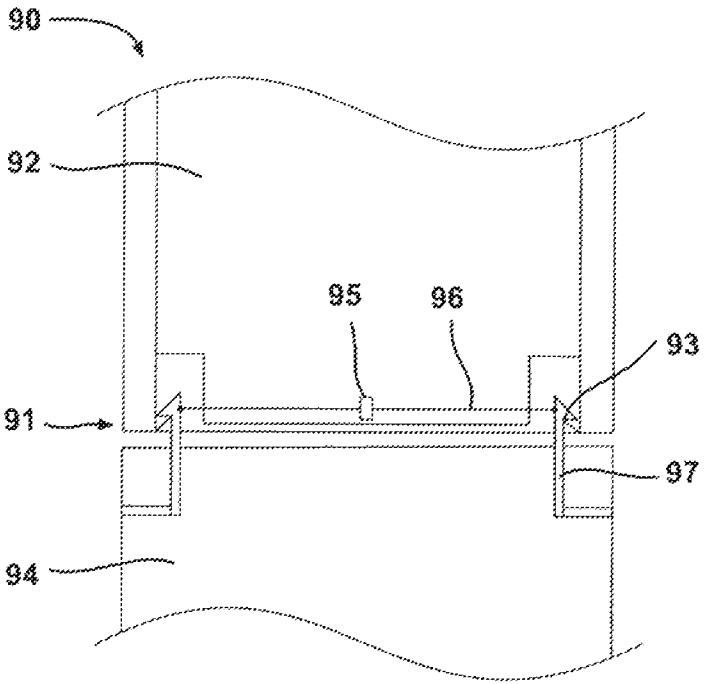
FIG. 9 is a schematic diagram illustrating another embodiment of a fragmentation adjustment system including a release mechanism with compliant latches according to features of the present invention.

In FIG. 9, the release mechanism 90 includes a plurality of latches 91 that may be evenly spaced around the circumference of the munition. A fixed anchor point 95 couples a shape memory alloy wire 96 (or other linear actuator) to compliant beams 97 with interlocking pawls 93. Actuation deflects the beams 97 and releases the near field barrier 92, or guidance system, via the force of the coil spring (not shown), for example, for displacement away from the warhead 94.

Figure 10:
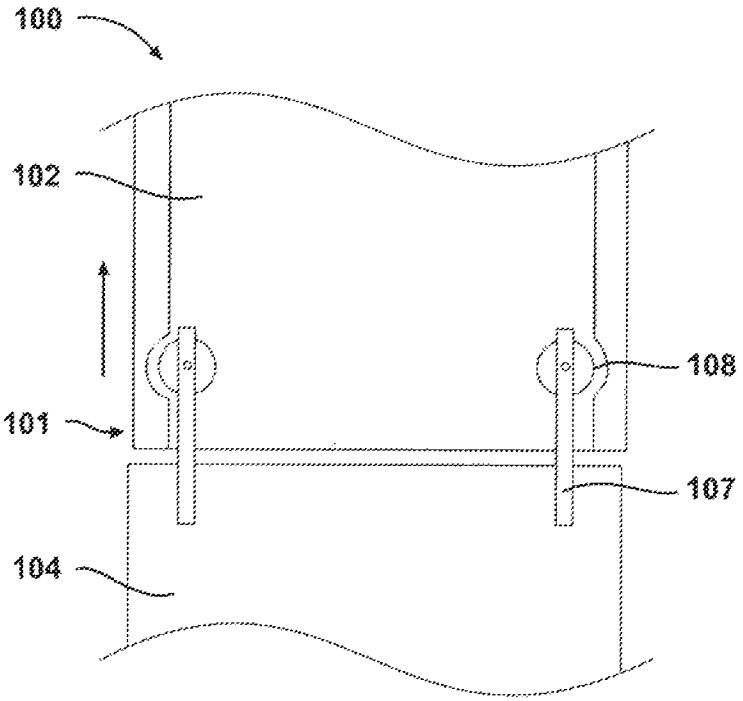
FIG. 10 is a schematic diagram illustrating another embodiment of a fragmentation adjustment system including release mechanism with rolling latches according to features of the present invention.

In FIG. 10, the release mechanism 100 includes a plurality of rolling latches 101 that may be evenly spaced around the circumference of the munition. Compliant beams 107 with ball bearings 108 are included. Actuation deflects the beams 107 and releases the near field barrier 102, or guidance system, for displacement away from the warhead 104.

The fragmentation adjustment system 40 may be customized to each class of precision munition by the munition manufacturer. It will be inserted between the munition and the near field barrier during munition buildup and configured to provide the appropriate length of near field barrier displacement. During use, the munition would be loaded onto the parent aircraft per standard procedure. Based on previously obtained test data and/or analysis, the user would specify at what point during the engagement the system should be activated to displace the near field barrier prior to detonation. This may be specified as a range to target or as time delay, for example. These settings would be programmed into the munition guidance system before launch. At that point, the munition would be used per standard procedure.

The structural components may be high strength plastics, composites or metals.

Embodiments of the present invention are also directed to a method of making a forward firing fragmentation (FFF) munition 10. The method includes: mounting a flight system 16 to the body 13, the flight system configured to maneuver the munition in flight; mounting a warhead 14 to the body 13, the warhead including an explosive configured to detonate and expel fragments in a pattern; mounting a near field barrier (NFB) 12, such as a guidance system, to the body 13 in front of the warhead 14 and communicatively coupled via a communication link 64 to the flight system 16; and providing a fragmentation adjustment system 40 to physically displace the near field barrier 12 relative to the warhead 14 while maintaining the communication link between the guidance system and the flight system 16 prior to detonation of the explosive.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the appended claims and their legal equivalents, and not by the examples given.

We claim:

1. A forward firing fragmentation munition comprising:

a body;

a flight system carried by the body and configured to maneuver the munition in flight;

a warhead carried by the body and including an explosive configured to detonate and expel fragments in a pattern;

a near field barrier carried by the body in front of the warhead and communicatively coupled via a communication link to the flight system; and a fragmentation adjustment system configured to physically displace the near field barrier relative to the warhead while maintaining the communication link between the near field barrier and the flight system until detonation of the explosive.

2. The forward firing fragmentation munition according to claim 1 further comprising an engine carried by the body and configured to propel the forward firing fragmentation munition in flight.

3. The forward firing fragmentation munition according to claim 1 wherein the near field barrier comprises a guidance system.

4. The forward firing fragmentation munition according to claim 3 wherein the fragmentation adjustment system comprises an axial displacement system configured to axially displace the guidance system in a forward direction away from the warhead prior to detonation of the explosive while maintaining a physical coupling between the guidance system and the body and maintaining the communication link between the guidance system and the flight system until detonation of the explosive.

5. The forward firing fragmentation munition according to claim 4 wherein the axial displacement system comprises at least one linear guide coupled between the body and the guidance system.

6. The forward firing fragmentation munition according to claim 5 wherein the at least one linear guide comprises a plurality of extendable rods.

7. The forward firing fragmentation munition according to claim 6 wherein the at least one linear guide comprises a sleeve.

8. The forward firing fragmentation munition according to claim 6 wherein the axial displacement system comprises a plurality of communication tethers defining the communication link.

9. The forward firing fragmentation munition according to claim 1 wherein the fragmentation adjustment system comprises a pivotal displacement system configured to rotate the near field barrier in a direction away from the warhead prior to detonation of the explosive while maintaining a physical coupling between the near field barrier and the body and maintaining the communication link between the near field barrier and the flight system until detonation of the explosive.

10. The forward firing fragmentation munition according to claim 1 wherein the fragmentation adjustment system comprises a release mechanism configured to release the near field barrier for displacement away from the warhead prior to detonation of the explosive.

11. The forward firing fragmentation munition according to claim 10 wherein the fragmentation adjustment system further comprises a biasing mechanism configured to bias the near field barrier for displacement away from the warhead upon actuation of the release mechanism and prior to detonation of the explosive.

12. A method of making a forward firing fragmentation (FFF) munition, the method comprising:

mounting a flight system to the body, the flight system configured to maneuver the munition in flight;

mounting a warhead to the body, the warhead including an explosive configured to detonate and expel fragments in a pattern;

mounting a near field barrier to the body in front of the warhead and communicatively coupled via a communication link to the flight system; and providing a fragmentation adjustment system to physically displace the near field barrier relative to the warhead while maintaining the communication link between the guidance system and the flight system prior to detonation of the explosive.

13. The method according to claim 12 wherein the near field barrier comprises a guidance system.

14. The method according to claim 12 wherein the fragmentation adjustment system comprises an axial displacement system configured to axially displace the guidance system in a forward direction away from the warhead prior to detonation of the explosive while maintaining a physical coupling between the guidance system and the body and maintaining the communication link between the guidance system and the flight system until detonation of the explosive.

15. The method according to claim 12 wherein the fragmentation adjustment system comprises a pivotal displacement system configured to rotate the near field barrier in a direction away from the warhead prior to detonation of the explosive while maintaining a physical coupling between the near field barrier and the body and maintaining the communication link between the near field barrier and the flight system until detonation of the explosive.

16. The method according to claim 12 wherein the fragmentation adjustment system comprises:

a release mechanism configured to release the near field barrier for displacement away from the warhead prior to detonation of the explosive; and a biasing mechanism configured to bias the near field barrier for displacement away from the warhead upon actuation of the release mechanism and prior to detonation of the explosive.

* * * * *